United States Patent [19]

Conover

[11] Patent Number: 4,512,217

[45] Date of Patent: Apr. 23, 1985

[54] LINEAR RATCHET

[76] Inventor: William S. Conover, 351 Huntington Ave., Buffalo, N.Y. 14214

[21] Appl. No.: 516,110

[22] Filed: Jul. 22, 1983

[51] Int. Cl.[3] ..... B25B 13/00

[52] U.S. Cl. ..... 81/58; 81/60; 81/57.46; 74/129

[58] Field of Search ..... 81/57.39, 57.46, 58, 81/60, 61, 177 R; 74/30, 128–130, 132

[56] References Cited

U.S. PATENT DOCUMENTS

| | | | |
|---|---|---|---|
| 739,538 | 9/1903 | Fredson | 74/132 X |
| 2,507,681 | 5/1950 | Sage | 81/57.46 X |
| 2,755,619 | 7/1956 | Sheft | 74/132 X |
| 2,896,952 | 7/1959 | Wurm | 74/132 X |
| 3,383,962 | 5/1968 | Harris | 81/177 R X |
| 4,335,853 | 6/1982 | Szemeredi | 74/129 X |
| 4,339,969 | 7/1982 | Hage | 81/57.39 |

*Primary Examiner*—Frederick R. Schmidt
*Assistant Examiner*—Debra S. Meislin
*Attorney, Agent, or Firm*—Sommer & Sommer

[57] ABSTRACT

A ratchet wrench has a member provided with a graspable handle. Two toothed racks are mounted on the member and biased to move inwardly of a slot. A socket has a pawl-like toothed portion extending circumferentially thereabout and engaging both racks. The teeth of the racks are arranged to face in opposite directions. In use, the operator may move the member-handle combination linearly to impart rotary motion to the socket when in engagement with a workpiece.

7 Claims, 3 Drawing Figures

LINEAR RATCHET

BACKGROUND OF THE INVENTION

1. Field of the Invention:

The present invention relates generally to the field of ratchet wrenches, and more particularly to an improved ratchet wrench in which a handle is moved linearly to impart rotary motion to a socket.

2. Description of the Prior Art:

Ratchet wrenches are, of course, well known. Existing wrenches of this type usually have a handle portion which is arranged to rotate a square fitting when the handle is selectively moved in one angular direction, but is arranged to slip relative to the fitting when moved in the opposite angular direction. Sockets of different sizes are adapted to be received on the fitting.

However, there are instances where the tightness of space precludes the use of a rotatable ratchet wrench.

SUMMARY OF THE INVENTION

With parenthetical reference to the preferred embodiment disclosed in the specification for exemplary purposes only, the present invention provides an improved linearly-reciprocable ratchet wrench (e.g., 10) which broadly comprises: an elongated member (e.g., 11) having an axis (e.g., axis x—x), having an axial slot (e.g., 28), having two recesses extending into the member from either side of the slot and having a handle (e.g., 43) extending axially away from one end of the member in a direction away from the slot; a rack (e.g., 12,13) mounted on the member and arranged in each member recess for movement toward and away from the axis, each rack having a plurality of ratchet teeth extending into the slot, one rack being arranged so that the abutment surfaces (e.g., 54) of its teeth are arranged to face toward the handle, the other rack being arranged so that the abutment surfaces of its teeth are arranged to face away from the handle; a spring (e.g., 14,15) operatively arranged between the member and each rack for urging the associated rack to move toward the axis; and a socket (e.g., 16) arranged in the slot and having a pawl-like toothed portion (e.g., 55) engaging the teeth of each rack, and having a recess (e.g., 56) adapted to receive the head of a fastener; whereby an operator may grasp the handle and move the member in either axial direction to impart rotary motion to the socket when in engagement with a workpiece.

Accordingly, the general object of the invention is to provide an improved ratchet wrench.

Another object is to provide an improved ratchet wrench in which unidirectional linear motion of a member is transformed into rotary motion of a socket.

These and other like objects and advantages will become apparent from the foregoing and ongoing specification, the drawings, and the appended claims.

DESCRIPTION OF THE PREFERRED EMBODIMENTS

Figures 1, 2, 3:
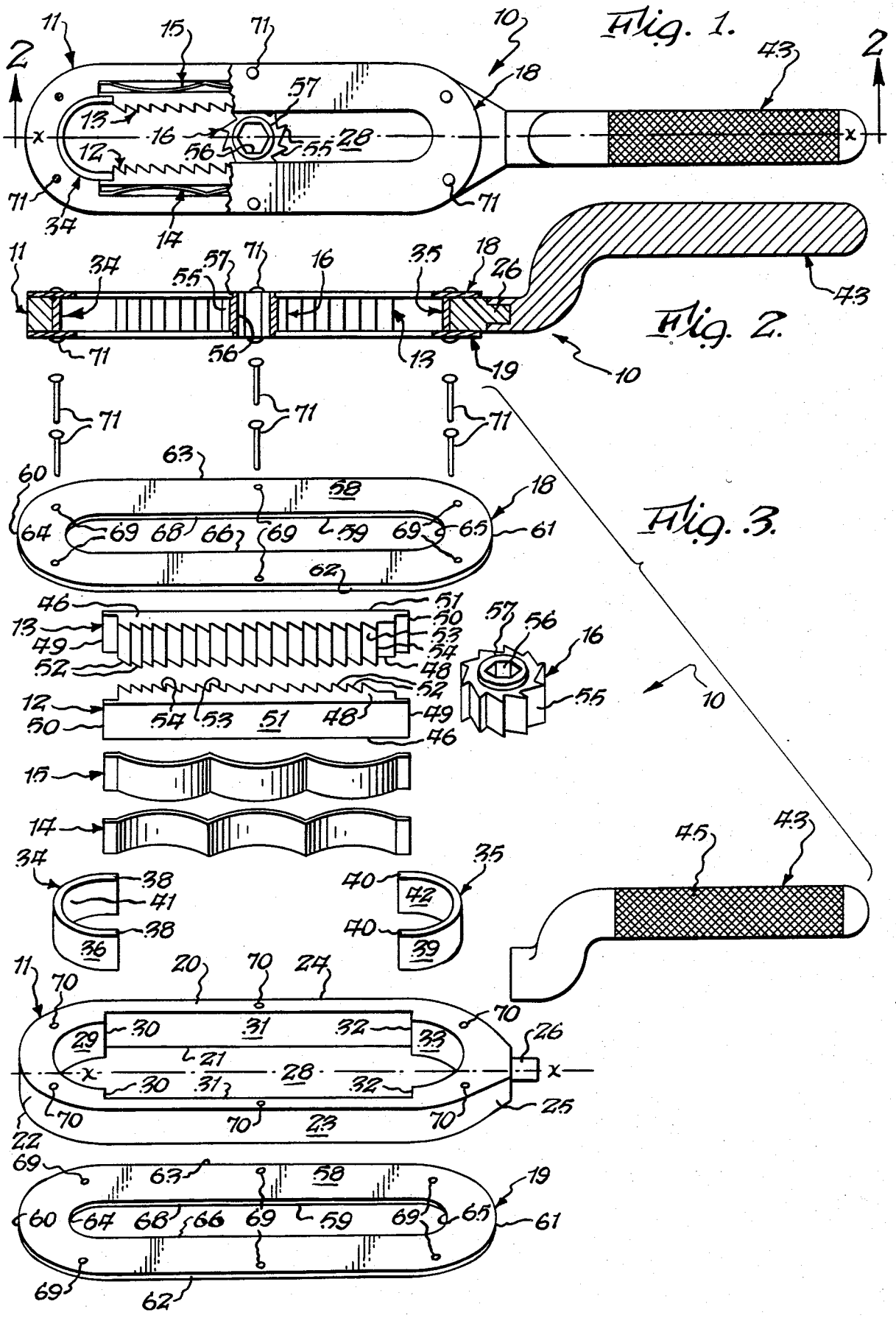
FIG. 1 is a top plan view of the improved ratchet wrench, this view showing a socket as engaging the teeth of both racks.
FIG. 2 is a fragmentary vertical sectional thereof, taken generally on line 2—2 of FIG. 1.
FIG. 3 is an exploded view of the improved wrench.

At the outset, it should be clearly understood that like reference numerals are intended to identify the same structure, portions, or elements consistently throughout the several drawing figures, as such structure, portions or elements may be further described or explained by the entire written specification of which this detailed description is an integral part.

Referring now to the drawings, this invention provides a linearly-reciprocable ratchet wrench, of which the presently-preferred embodiment is generally indicated at 10. As best shown in FIG. 3, this preferred embodiment broadly includes: an elongated-member 11; two racks 12,13; two springs 14,15; a socket 16; and upper and lower cover plates 18,19, respectively.

Member 11 is elongated along a horizontal axis x—x; has planar horizontal upper and lower surfaces 20,21, respectively; and has an outer vertical side surface which includes a leftward rounded surface 22, longitudinally-extending planar parallel side surfaces 23,24; and a rightward generally-rounded surface 25. A pivot pin indicated at 26, extends rightwardly from its rounded right surface 25. The member is also provided with an axially-elongated vertical through-slot, indicated at 28, which communicates upper and lower member surfaces 20,21. This slot is bounded by a vertical wall which specifically includes rightwardly-facing cylindrical surface 29, rightwardly-facing coplanar surfaces 30,30 extending laterally outwardly therefrom, longitudinally-extending surfaces 31,31, which are spaced horizontally from one another, leftwardly-facing coplanar surfaces 32,32 extending laterally inwardly therefrom, and leftwardly-facing cylindrical surface 33.

A C-shaped insert 34 is fixedly mounted in the leftward end of the slot, and another C-shaped insert 35 is suitably secured in the rightward end of the slot. Both inserts have a vertical thickness substantially equal to the vertical thickness of member 11 so that their upper and lower horizontal faces will be substantially coplanar with upper and lower member surfaces 20,21. The left insert 34 has a leftwardly-facing cylindrical surface 36 engaging member surface 29, and has two distal marginal end portions 38,38 extending longitudinally and rightwardly beyond member surfaces 30,30. Similarly, the right insert 35 has a rightwardly-facing cylindrical surface 39 engaging member surface 33, and has its two distal marginal end portions 40,40 extending longitudinally and leftwardly beyond member surfaces 32,32. These insert marginal portions, 38,38 and 40,40, function to provide stops for limiting inward movement of the racks in a direction toward the axis. The left insert has a rightwardly-facing cylindrical inner surface 41. The right insert has a leftwardly-facing cylindrical inner surface 42.

A handle, generally indicated at 43, receives pin 26 at its left end, so as to rotatably mount the handle on the member. The handle is somewhat S-shaped, when viewed in longitudinal cross-section (FIG. 2), and has a rightward vertically-elevated graspable portion 45, the exterior surface of which may be suitably knurled. Thus, the position of the member may be reversed with respect to the illustrated position of the handle.

Racks 12,13 are structurally identical to one another, although oriented in different positions when installed on the member. Because of their structural identity, only one rack will be explicity described. However, persons skilled in this art will readily appeciate that a specific reference numeral will indicate the corresponding structure portion or element of the other rack in the accompanying drawings. Rack 13 is shown as having upper and lower planar horizontal faces 46,48 which are coplanar with upper and lower member surfaces 20,21, respectively; planar vertical left and right end faces 49,50, respectively; a longitudinally-extending planar surface 51 arranged to face outwardly away from the axis; and an inner surface having a plurality of continuous ratchet teeth 52 arranged to face inwardly toward the axis. Each ratchet tooth is somewhat saw-toothed in appearance, and is defined by an inclined or sloped surface 53, and an abutment surface 54 arranged in a plane perpendicular to axis x—x. Rack 13 is arranged so that the abutment surfaces of its teeth face rightwardly, while rack 12 is arranged such that the abutment surfaces of its teeth face leftwardly. The racks are mounted on the body in the somewhat T-shaped recesses defined by insert extensions 38,40 and member surfaces 30,31,32. The horizontal width of each rack is less than the horizontal spacing between an associated insert extension 38 or 40 and member surface 33, so that each rack is mounted loosely in a recess for movement toward and away from the axis.

Springs 14,15 are arranged in the member recesses to act between the member and the associated rack. These springs, which are shown as being undulating leaf springs, function to continuously urge the associated rack to move toward the axis for a purpose later explained. Specifically, spring 14 is arranged to act between one member surface 31 and surface 51 of rack 12, while spring 15 is arranged to act between the other member surface 31 and surface 51 of rack 13.

The socket 16 has a pawl-like saw-toothed portion 55 extending circumferentially thereabout, and is provided with a recess 56, either blind or through extending upwardly from its lower face. Cylindrical collar portions 57 of the socket's side wall extend upwardly and downwardly from the toothed portion 55, and penetrate the slots in the upper and lower covers. Recess 56 has a cross-section, typically hexagonal, configured to receive a correspondingly-configured head of a fastener (not shown). If desired, this recess may extend completely through the socket (as shown). The exterior teeth of the socket are also of the ratchet-type, heretofore described, and are adapted to engage the teeth of the racks. Of course, because the racks are oriented such that the abutment surfaces 54 of their teeth face in opposite directions, the pawl-like teeth of the socket will be thrustingly engaged by the teeth of one rack, but will be permitted to slip over the teeth of the other rack.

The upper and lower covers 18,19 are structurally identical to one another. Hence, only one cover will be explicitly described. Cover 19 is formed of a sheet material, and has upper and lower planar horizontal faces 58,59; and outer surface including rounded left and right ends 60,61, respectively, and side surfaces 62,63 extending longitudinally therebetween; and has a vertical through-slot bounded by rounded left and right surfaces 64,65, respectively, and side surfaces 66,68 extending longitudinally therebetween. The covers are dimensioned so as to prevent unintended separation of the racks, springs and the socket from the body member, without impeding operation of the improved wrench. Covers 18,19 are provided with a plurality of holes, severally indicated at 69 adapted to be aligned with corresponding member holes, severally indicated at 70, and to accommodate passage of a plurality of fasteners, severally indicated at 71, by which the upper cover-member-lower cover subassembly may be held together.

OPERATION

In use, an operator simply places the socket on the head of the fastener (not shown) to be rotated relative to an object (not shown), positions the member so that the socket will be operatively arranged between the two inwardly-biased racks, and rotates the handle so as to be positioned above an object. Thereafter, the operator grasps the handle and moves the handle linearly in one direction along axis x—x. The abutment surfaces of one of the racks will engage the abutment surfaces of the socket teeth and cause the socket to rotate, thereby tightening or loosening the fastener relative to the object (as desired). It should be noted that the pawl will slip along the other rack by virtue of the orientation of the teeth. To rotate the socket in the opposite angular direction, the operator need only invert the member, reengage it with the fastener (not shown), and reverse the position of the rotatable handle so as to be again positioned as shown in FIG. 2 relative to the nowinverted member. Thereafter, the operator may again move the member-handle subassembly in a linear direction along axis x—x to selectively rotate the socket in the appropriate angular direction. It should be noted that the orientation of the teeth on the two racks and the socket is such that the socket will be rotated when the member is moved axially in one direction, and will be similarly moved when the member is moved in the opposite axial direction, until the position of the member is reversed.

Of course the present invention contemplates that many changes and modifications may be made. The invention expressly contemplates that differently-sized sockets may be used, or that a single socket may receive suitable polygonal inserts to adapt the socket to the head size of different fasteners. For example, the inserts may be formed integrally with the member, or separately, as desired. The particular manner by which the handle is rotatably connected to the member is not deemed critical. Also, the materials of construction are not deemed critical. Therefore, while the presently-preferred embodiment of the improved wrench has been shown and explicitly described, persons skilled in this art will readily appreciate that various additional changes and modifications may be made without departing from the spirit of the invention as defined and differentiated by the following claims.

What is claimed is:

1. A linearly-reciprocable ratchet wrench, comprising:

an elongated member having an axis, having an axial slot, having a recess extending transversely into said member from either side of said slot, and having a handle connected to and extending axially away from one end of said member in a direction away from said slot;

a rack mounted on said member and arranged in each recess for movement toward and away from said axis, each rack having a plurality of ratchet teeth extending into said slot, each of said ratchet teeth having an inclined surface and an abutment surface, one rack being arranged so that the abutment surfaces of its teeth are arranged to face toward said handle, the other rack being arranged so that the abutment surfaces of its teeth are arranged to face away from said handle;

a spring operatively arranged between said member and each rack for urging the associated rack to move toward said axis; and a socket arranged in said slot for rotational and linear motion relative to said member and having a pawl-like toothed portion engaging the teeth of each rack, and having a recess adapted to receive the head of a fastener, said socket being rotatable in one angular direction when said member is moved in one axial direction relative to said socket and being rotatable in the same angular direction when said member is moved in the opposite axial direction relative to said socket;

whereby an operator may grasp said handle and move said member in either axial direction relative to said socket to rotate said socket in one angular direction.

2. A linearly-reciprocable ratchet wrench as set forth in claim 1 wherein one end of said slot is arcuate.

3. A linearly-reciprocable ratchet wrench as set forth in claim 1 wherein each spring is a leaf spring.

4. A linarly-reciprocable ratchet wrench as set forth in claim 1 wherein said member is provided with at least one stop surface arranged to limit movement of an associated rack toward said axis.

5. A linearly-reciprocable ratchet wrench as set forth in claim 1 wherein said handle is rotably mounted on said member.

6. A linearly-reciprocable ratchet wrench as set forth in claim 1 wherein said handle has a graspable portion offset from the handle which is adapted to be connected to said member.

7. A linearly-reciprocable ratchet wrench as set forth in claim 1, and further comprising:

at least one cover mounted on said member to prevent unintended separation of said racks and springs from said member.

* * * * *